US008974327B2

(12) United States Patent
Priore

(10) Patent No.: US 8,974,327 B2
(45) Date of Patent: Mar. 10, 2015

(54) HUNTING ARROWHEAD HAVING FIXED AND EXPANDABLE BLADES

(71) Applicant: Rocco Nicola Priore, Zephyr (CA)

(72) Inventor: Rocco Nicola Priore, Zephyr (CA)

( * ) Notice: Subject to any disclaimer, the term of this patent is extended or adjusted under 35 U.S.C. 154(b) by 84 days.

(21) Appl. No.: 13/917,966

(22) Filed: Jun. 14, 2013

(65) Prior Publication Data

US 2014/0371010 A1 Dec. 18, 2014

(51) Int. Cl.
*F42B 6/08* (2006.01)

(52) U.S. Cl.
CPC ..... *F42B 6/08* (2013.01)
USPC ..... 473/583

(58) Field of Classification Search
CPC ..... F42B 6/08
USPC ..... 473/583, 584
See application file for complete search history.

(56) References Cited

U.S. PATENT DOCUMENTS 5,090,709 A * 2/1992 Johnson ..... 473/584
6,322,464 B1 11/2001 Sestak
6,554,727 B1 4/2003 Armstrong et al.
8,062,155 B2 11/2011 Butcher

* cited by examiner

*Primary Examiner* — John Ricci
(74) *Attorney, Agent, or Firm* — Nasser Ashgriz; U1Patent Inc.

(57) ABSTRACT

An arrowhead having a combination of fixed and expandable blades is provided. The new arrowhead has three mechanically expandable blades and six fixed blades. An expandable blade is snug fitted in between two fixed blades, eliminating the need for a mechanism to hold the expandable blade during the flight. In one embodiment of the present arrowhead, the expandable blades pivotally open from the front end of the arrowhead. And in the second embodiment of the present arrowhead, the expandable blades pivotally open from the rear end of the arrowhead.

17 Claims, 13 Drawing Sheets

HUNTING ARROWHEAD HAVING FIXED AND EXPANDABLE BLADES

FIELD OF THE INVENTION

The present invention relates to arrowheads and broadheads.

BACKGROUND AND SUMMARY OF THE INVENTION

Various assemblies for enhancing the performance of arrowheads have been proposed. The main design objective of an arrowhead is to enhance both the flying performance and the striking power of the arrow when hitting the target.

Small arrowheads have lower aerodynamics drag and provide accurate flight pattern, but at the same time, they have lower striking power compared to the larger arrowheads. Hunters have had to choose between small arrowheads that fly accurately, or large arrowheads that do not fly accurately but have higher striking power.

In order to overcome this issue and to have both power and accuracy, arrowheads with mechanically expandable blades are introduced. Mechanically expandable blades remain small in diameter when flying and before hitting the target. The arrowhead expands in diameter only upon contact with the target, creating a larger area of penetration and a wide cut surface.

The expandable blades, however, have several drawbacks. If the arrowhead with expandable blades hits the target at an angle, the blades may not open causing the arrow to ricochet away from the target. Further, as the expandable blades open only after penetrating into the animal's body, they have greater tendency to bounce off from the target than the fixed blades. Moreover, expandable blades are fragile compared to fixed blades and they may break upon contact, preventing them from normal functioning and making them unreliable in operation. These limitations have been circumvented by using a combination of fixed and expandable blades. Fixed blades in this case can be smaller in size and they can act as a support for the expandable blades to guarantee their proper functioning.

The following U.S. Patents are examples of arrowhead having both fixed and expandable blades. U.S. Pat. No. 6,322,464 B1 to Sestak titled HUNTING ARROWHEAD WITH BROADHEAD AND EXTENDABLE BLADES, introduced an arrowhead with one broadhead and two extendable blades, where the expandable blades pivot in a plane of movement perpendicular to the plane of the fixed broadhead blade. U.S. Pat. No. 6,554,727 B1 to Armstrong et al. titled DEFLECTION-RESISTANT ARROWHEAD HAVING BOTH FIXED AND MECHANICALLY EXPANDABLE BLADES, proposed an improved arrowhead with a spearpoint blade mounted on the tip of the arrowhead to provide entry into the target before the expandable blades are deployed. In a related invention, U.S. Pat. No. 8,062,155 B2 to Butcher titled ARROWHEAD HAVING BOTH FIXED AND MECHANICALLY EXPANDABLE BLADES, the number of expandable blades is increased and two sets of expandable blades are located proximate to the base of the fixed blade portion to allow the fixed blade to penetrate the target before the expandable blades are deployed.

Although several mechanisms have been proposed for arrowheads having both fixed and moving blades, the design of the arrowheads can still be improved and modified for higher effectiveness. In the present invention, an arrowhead with multiple fixed and expandable blades is proposed, where the expandable blades are mounted between the fixed blades to ensure the opening of the expandable blades and the penetration of the hunting arrow into the animal's body.

SUMMARY OF THE INVENTION

The present invention introduces an improved arrowhead having both fixed and expandable blades. Three sets of blades are mounted at the tip of the arrowhead. Each set of blades is constituted of two fixed blades and one expandable blade, wherein the expandable blade is located in between the two fixed blades. The blades are situated close to the tip of the arrowhead in order to minimize the time between entry of arrow tip and the beginning of deployment of the expandable blades. The present design ensures the proper opening of the expandable blades and it protects the moving blades from failure and breakdown.

The arrowhead includes a support body having substantially conical tip portion with nine longitudinal slots, grouped three by three, formed in the sides thereof. Each group of three slots serving as a housing for one expandable blade located in between two fixed blades. The expandable blades are in retracted configuration during arrow flight. The fixed blades are triangular shaped with a cutting edge extending rearwardly from the tip of the arrowhead. At the base of the arrowhead a threaded male connector is attached to allow the arrowhead to be mounted in a female threaded connector at the front of a hunting arrow shaft.

The first objective of the present invention is to increase the rigidity and robustness of the arrowhead, and to minimize the risk of its failure upon impact. The two fixed blades on both sides of the expandable blade act as a support for the expandable blade and prevent its potential breakdown. Further, fixed blades act as back up if mechanical blades fail to deploy.

The second objective of the present invention is to have a wider range of cutting surface with more damage to bone and vitals of an animal resulting in larger bleed out of animal causing animal to parish quickly acting as a humane form of hunting and easier to track blood trail to retrieve animal.

The third objective of the present invention is to minimize the risk of the expandable blade from staying closed when the tip of the arrow strikes the target. The expandable blades are placed in between fixed blades and they gradually expand while the fixed blades cut the animal's body and penetrate into the target.

The fourth objective of the present invention is to minimize the chance of the hunting arrow from being bounced off from the target. The fixed blades guarantee the initial cut of the animal's body and prevent the deflection of the arrow.

The fifth objective of the present invention is to use the hunting arrow for bow fishing. The fixed blades act as a hook for retrieval of the fish.

The aforementioned objectives of the present invention are attained by a specific combination of fixed and expandable blades. Other advantages and novel features of the present invention will become readily apparent from the following drawings and detailed description of preferred embodiments.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

Figure 1:
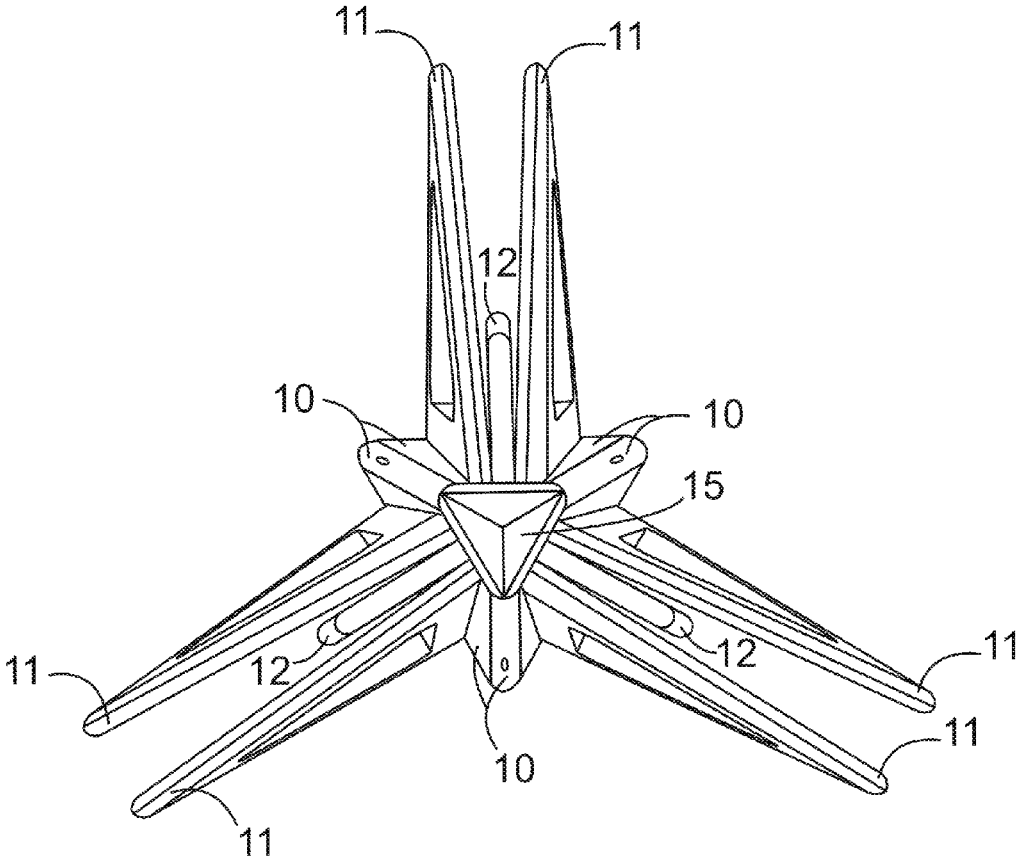
FIG. 1 shows the front view of the arrowhead.
Figure 2:
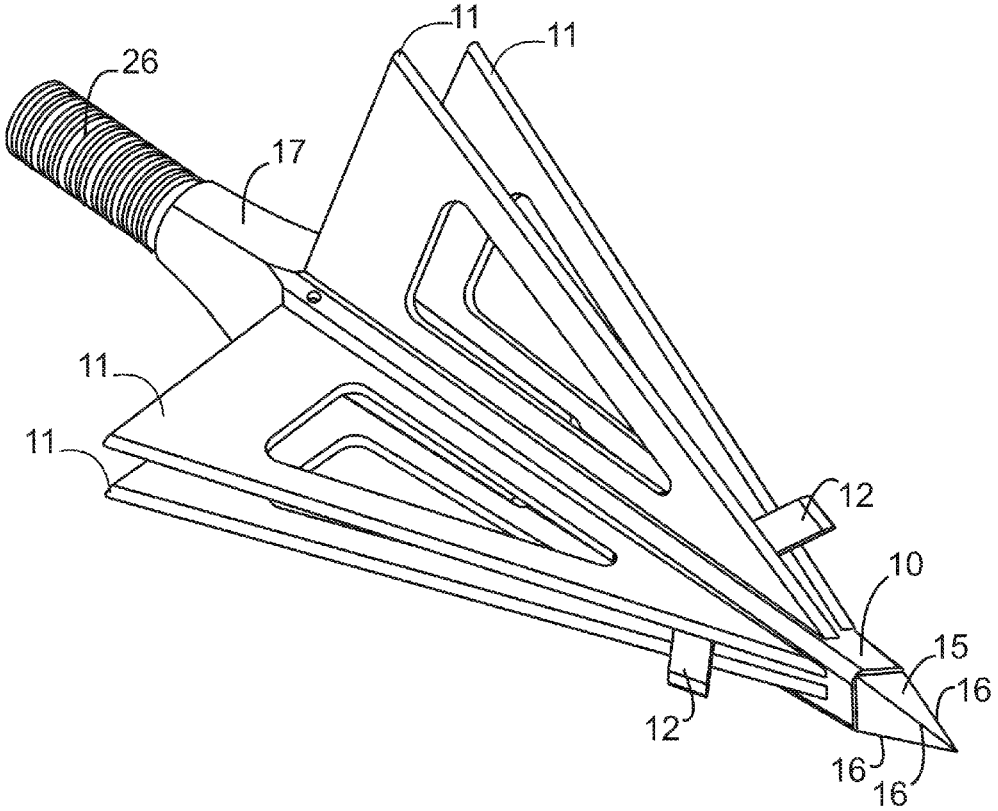
FIG. 2 shows a perspective view of the arrowhead with expandable blades in retracted position.

FIG. 1 shows the front view of the arrowhead. The arrowhead includes a triangular base pyramidal shaped main body 10, which supports six fixed blades 11 and three expandable blades 12. In FIG. 2, the perspective view of the main body 10 is shown which includes a connecting shaft 26 with a male threaded connection to mount the main body 10 on an arrow shaft (not shown). The main body 10 can be made of steel alloy, glass fiber reinforced plastics, stainless steel, or other metal, depending on the type and distance of target. The expandable blades 12 in FIG. 2 are held in retracted position with a stretchable elastic ring (not shown). The expandable blades 12 are set in between the two fixed blades 11 resulting in a reduced aerodynamics drag during the flight and an accurate flight pattern.

Figure 3:
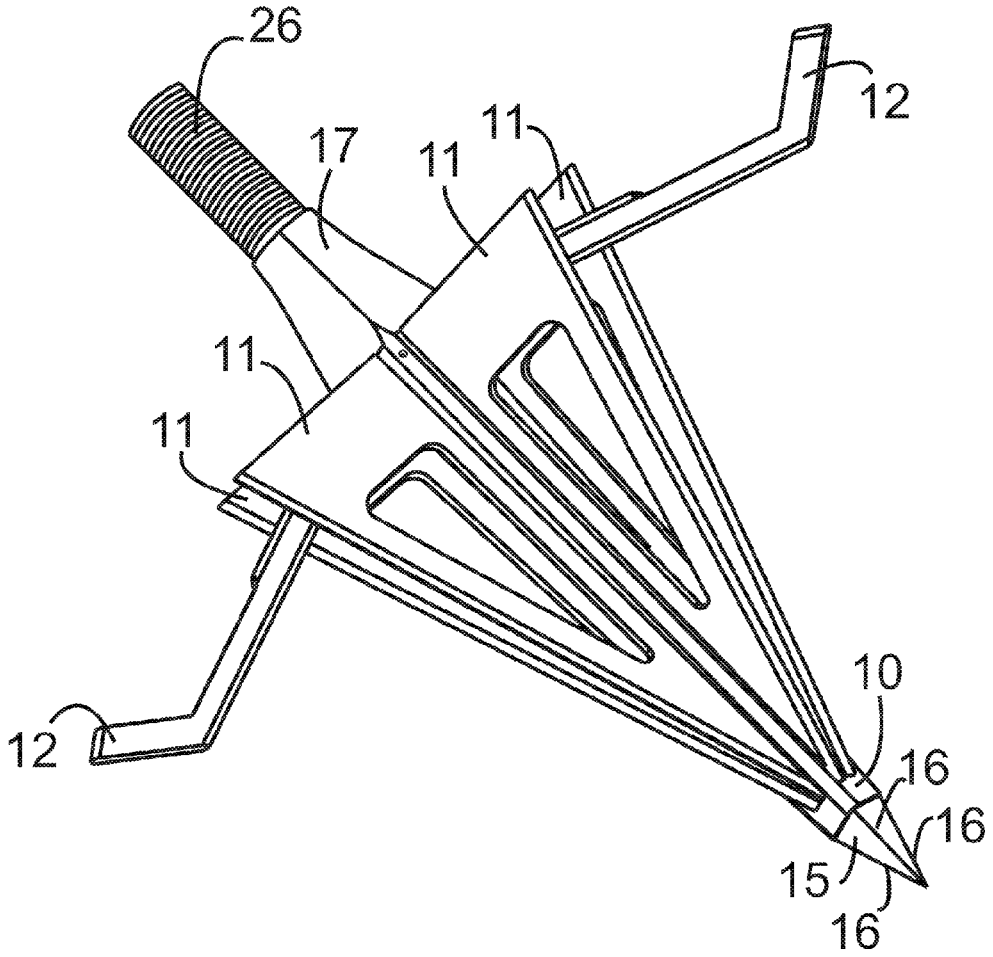
FIG. 3 shows a perspective view of the arrowhead with expandable blades in open position.

FIG. 3 shows the expandable blades 12 in open position when the arrowhead hits the target. When the blades are open they increase the cutting surface and they inflect more damage to animal's body. The tip 15 of the main body 10 is pyramidal shaped with plurality of lateral cutting edges 16. The tail 17 of the main body 10 is smoothly connected to the shaft 26 with a shallow angle to prevent the flow separation and turbulence behind the arrowhead and to reduce the aerodynamics drag of the arrowhead.

Figure 4:
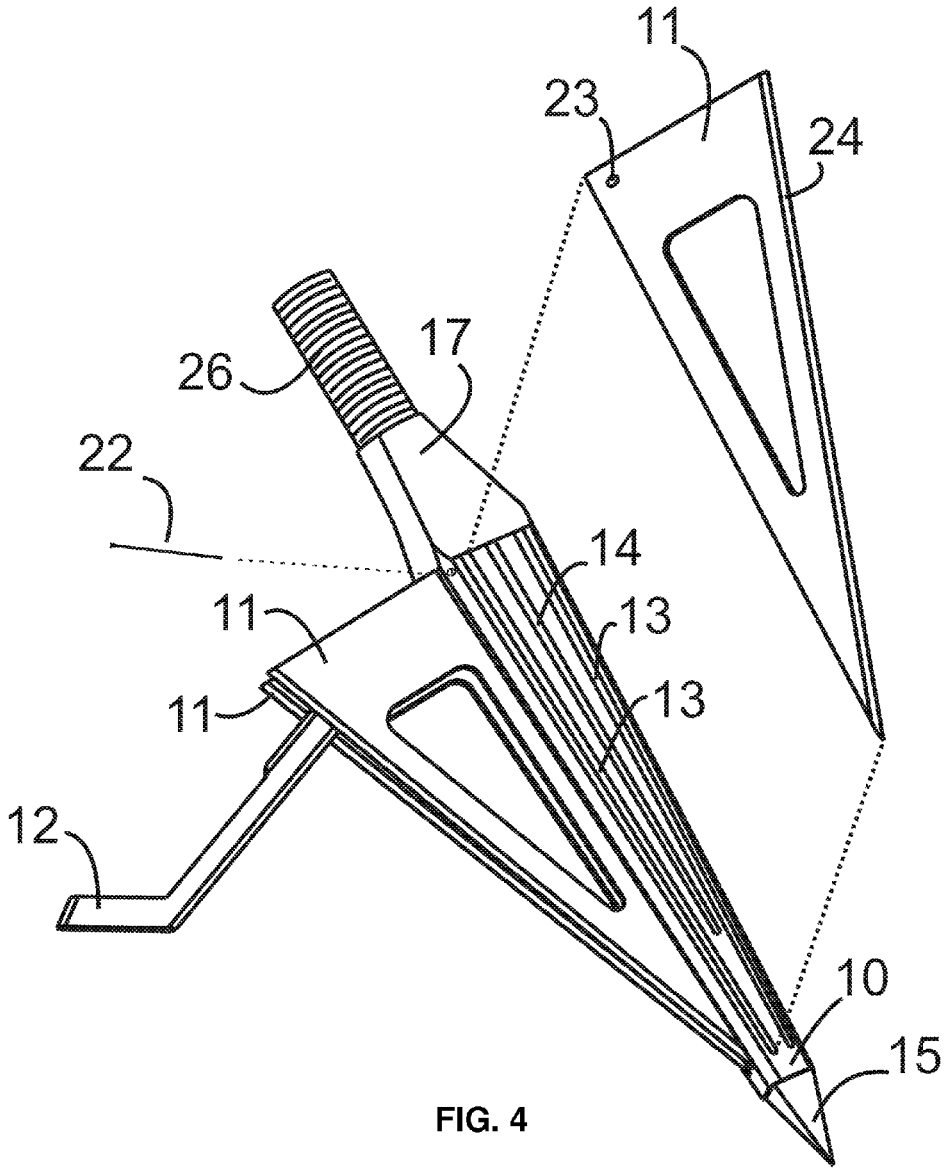
FIG. 4 shows the longitudinally grooved slots at one facet of the main body with the slot that matches a fixed blade.

As shown in FIG. 4, each facet of the triangular base main body 10 supports two pairs of fixed blades 11, and one pivotally mounted expandable blade 12. At each facet of the main body 10 two non-parallel slots 13 are grooved to receive two fixed blades 11. Another slot 14 is grooved to receive one expandable blade 12. The slot of the expandable blade (14) is between the slots of the fixed blades (13) and it is shorter than the other two. This configuration allows the opening of the expandable blade 12 shortly after the fixed blades 11 have penetrated into the animal's body, and reduces the risk of the expandable blade 12 to break or to stay closed after hitting the target. Furthermore, the two fixed blades 11 are not parallel. They make an acute angle with each other at the tip of the arrowhead to increase the cutting ability of the arrowhead. Moreover, the distance between the tips of the two fixed blades 11 is such that at each face of the main body, the expandable blade 13 can be snug fitted between two fixed blades 11, and, as a result, there is no need to keep the three expandable blades closed with an elastic rubber band. Alternatively, the fixed blades 11 may be integrally formed with the main body 10 as a whole unit.

The hunting arrow can also be used for fish hunting. In this case six fixed blades 11 ensure the retrieval of the fish when the arrowhead penetrates into the fish's body. The expandable blades 12 and the fixed blades 11 can be made of steel alloy, rigid plastic, stainless steel, or other metal, depending on the type of the target.

Again referring to FIG. 4, the fixed blades 11 have a hole 23 from which a pivot 22 passes and it rigidly fixes the blades 11 to the main body 10. The sharp cutting edge 24 of the fixed blade 11 is straight as shown in FIG. 4. Alternatively, the sharp cutting edge 24 can be curved. At each of three sides of the pyramidal shaped main body 10 a single pivot 22 is inserted through a hole 25 on the main body and it secures the three blades (two fixed and one expandable) together.

Figure 5:
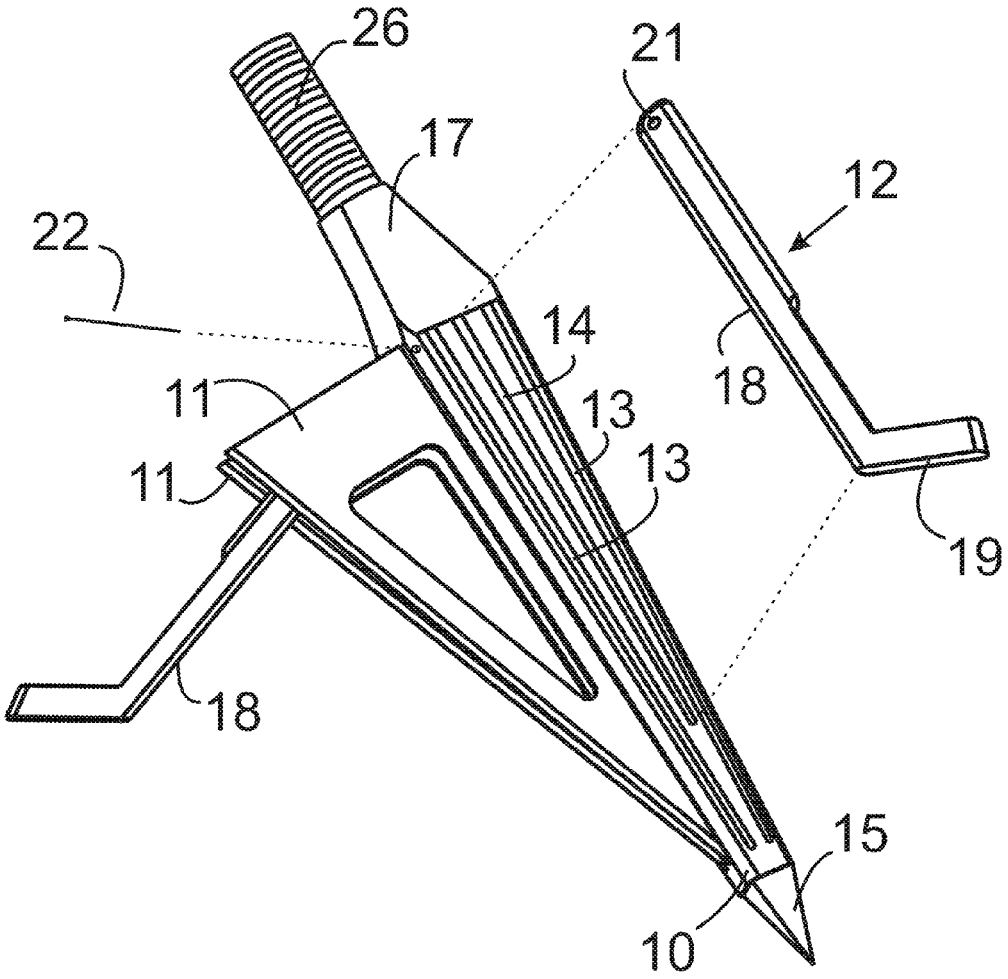
FIG. 5 shows the longitudinally grooved slots at one facet of the main body with the slot that matches an expandable blade.

In FIG. 5, the sharp edges 18 of the expandable blades 12 are shown. In closed position, the sharp edges 18 are placed within the slots 14 to protect them from damage and to make the arrowhead easier to handle by reducing the risk of cut fingers. A spur 19 is attached at the leading edge of the expandable blade 12, and it is extended outwardly away from the main body 10 when the expandable blades are in retracted position. The spur 19 enables the expandable blade 12 to start its deployment after the arrowhead hits the target and penetrates into the animal's body. The tail 20 of the expandable blade 12 is rounded and a hole 21 is formed at the end of each expandable blade 12 to allow free rotation of the blade 12 around the pivot 22.

Figure 6:
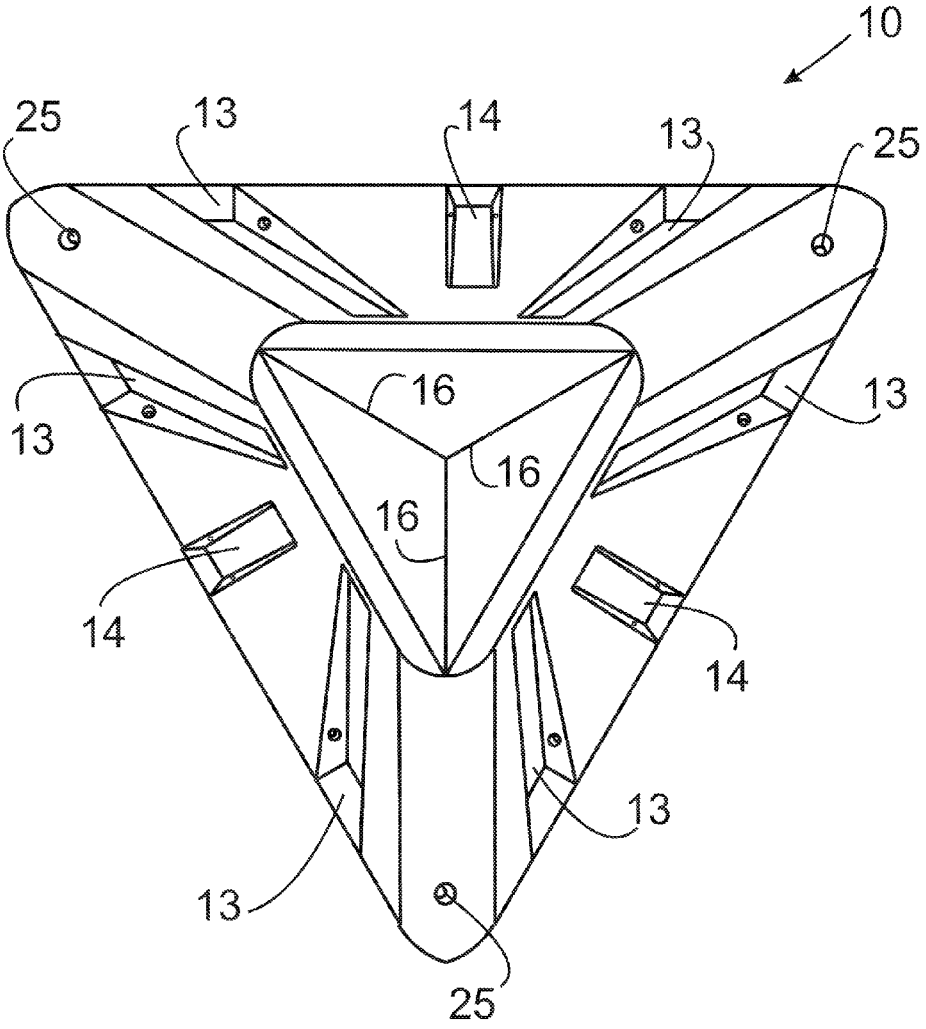
FIG. 6 shows the front view of the main body when all blades are removed.
Figure 7:
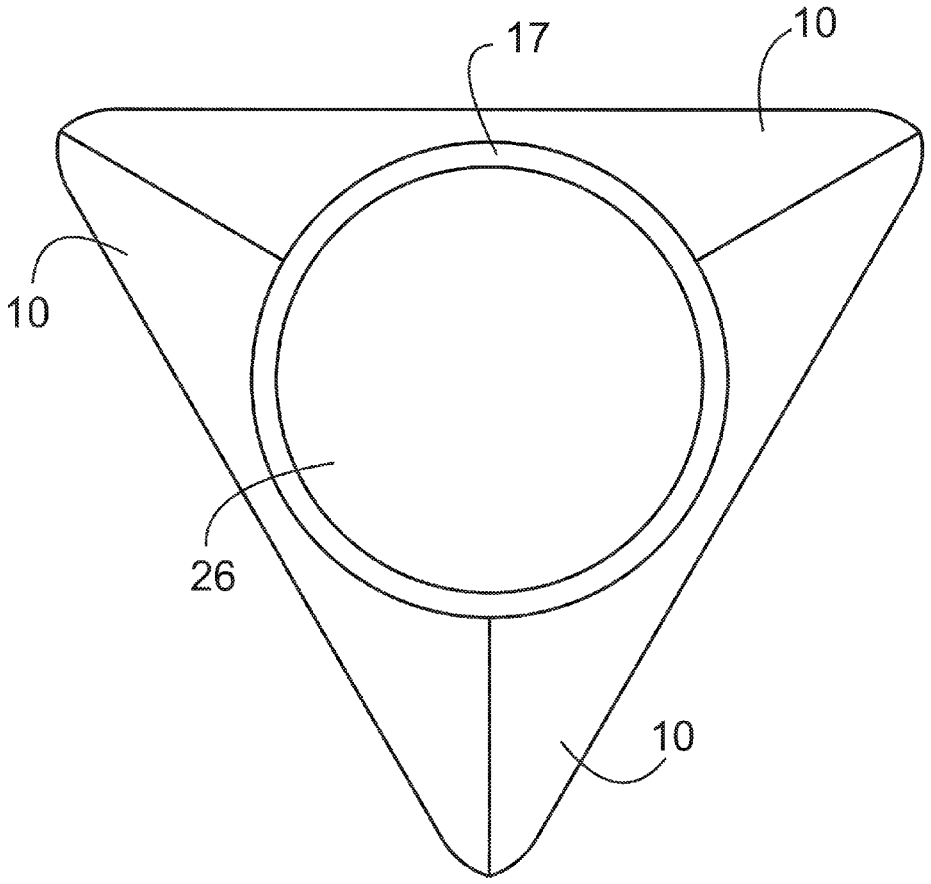
FIG. 7 shows the back view of the main body when all blades are removed.
Figure 8:
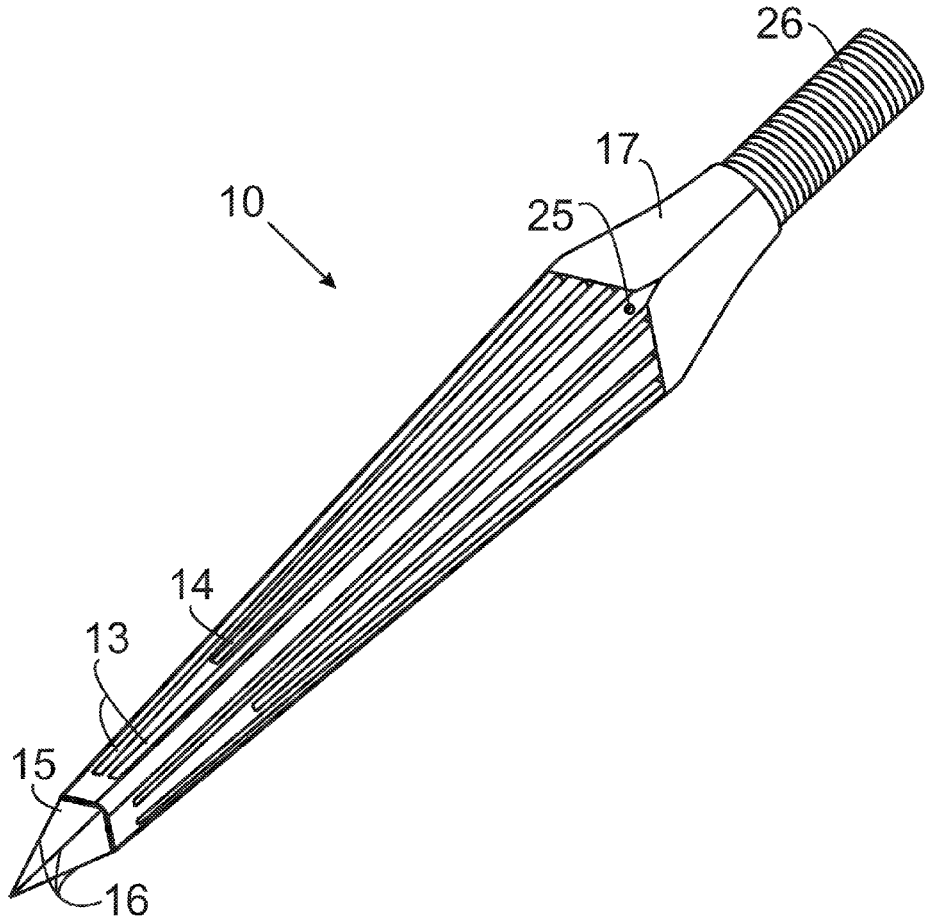
FIG. 8 shows the perspective view of the main body when all blades are removed.

In FIG. 6, the front view of the main body 10 is shown when all blades are removed. In total, there are six slots 13 to receive six fixed blades 11, and three slots 14 to receive three expandable blades. The triangular shape of the main body 10 allows an easy installation of 9 blades on a single arrowhead. In FIG. 7, the back view of the main body 10 is shown, and the perspective view of the main body is shown in FIG. 8.

Figure 9:
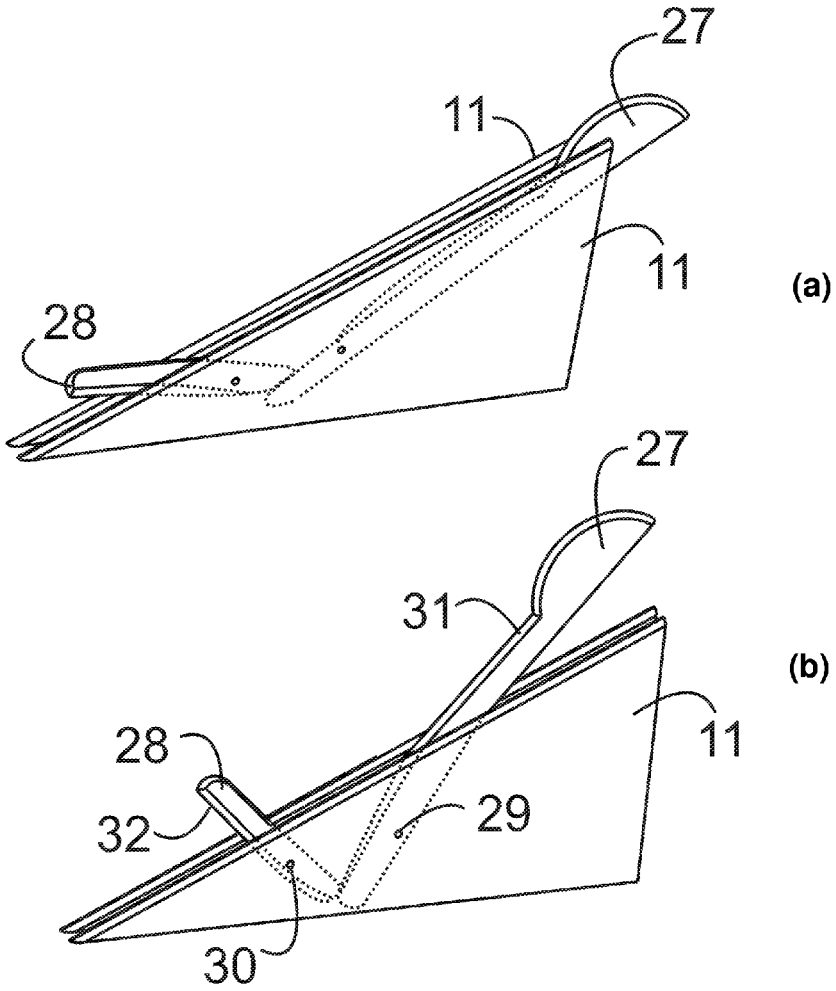
FIG. 9 shows another embodiment of the expandable blade with the expandable blades being mounted on the two fixed blades with a mechanism to allow opening of the blade from the rear side of the arrowhead.

In FIG. 9, another embodiment of the arrowhead is presented, wherein two expandable blades 27 and 28 are between two fixed blades 11 and they are pivoted to the sides of the fixed blades 11. In this embodiment, the expandable blades 27 and 28 are not installed on the main body 10, and, instead, they are mounted on the fixed blades 11. In FIG. 9*a* the expandable blades 27 and 28 are in a retracted position, with the expandable blades 27 and 28 being hidden between the fixed blades 11, thus reducing the aerodynamics drag of the arrowhead during the flight.

FIG. 9*b* shows the blades arrangement when the arrowhead hits the target and the expandable blade 28 starts rotating around its pivot 30 in the clockwise direction, pushing downward at the same time the distal end of the expandable blade 27 and making it to rotate in the counterclockwise direction around its pivot 29.

Figure 10:
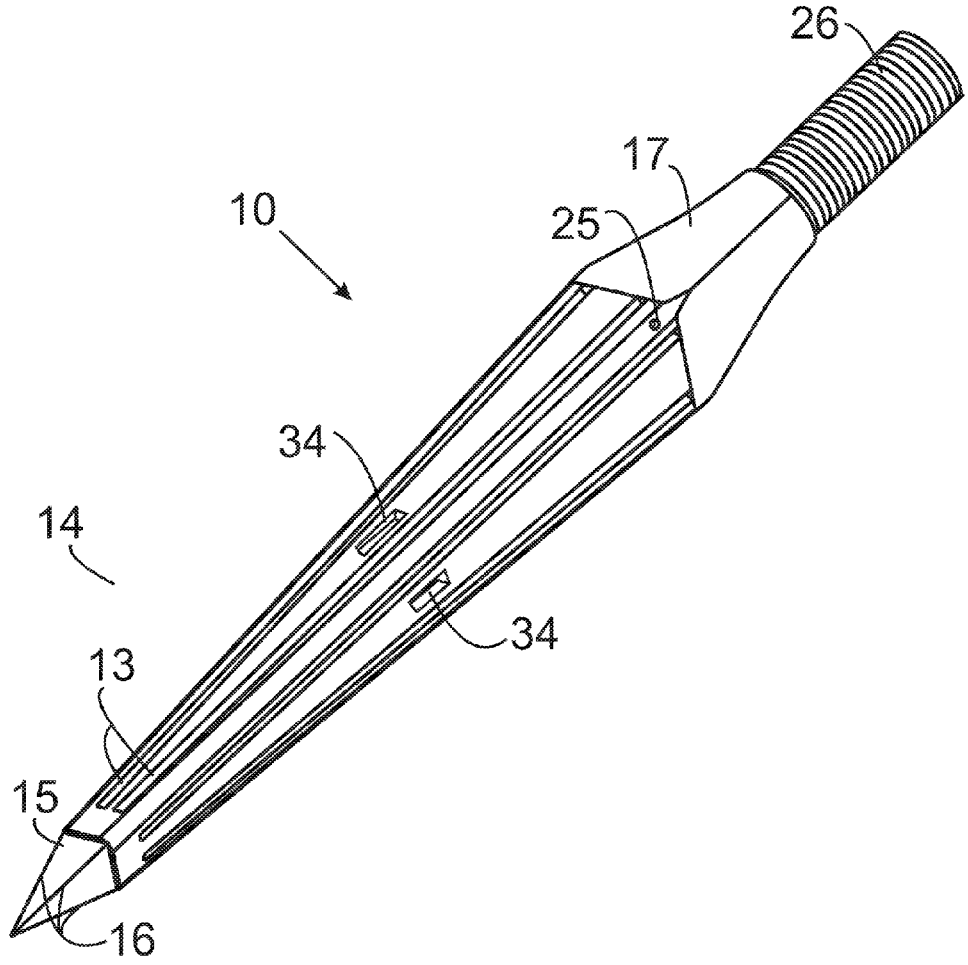
FIG. 10 shows the perspective view of the main body when all blades are removed in another embodiment of the present invention.

As shown in FIG. 9*b* the expandable blade 27 is fully opened when the central axes of the two blades 27 and 28 are perpendicular to each other. After the expandable blade 27 is fully opened, by further rotation of the expandable blade 28 in the clockwise direction, the expandable blade 27 will be locked in its position and it will stay open. In the locked position, shown in FIG. 9*b*, the distal end of the expandable blade 27 will be positioned in a small recess 34 in the main body as shown in FIG. 10. In the locked position, the angle between the axes of the two blades 27 and 28 is larger than a right angle (90 degree). Therefore, when the arrowhead penetrates into the animal body the two blades 27 and 28 stay open with their cutting edges 32 and 31 facing forward resulting to a larger cut and hemorrhage.

Base on expandable blade length, the small recess 34 can be designed in the main body. There is a possibility of no recess in the main body with small length of the expandable blade 27 in another embodiment of the present invention.

Figure 11:
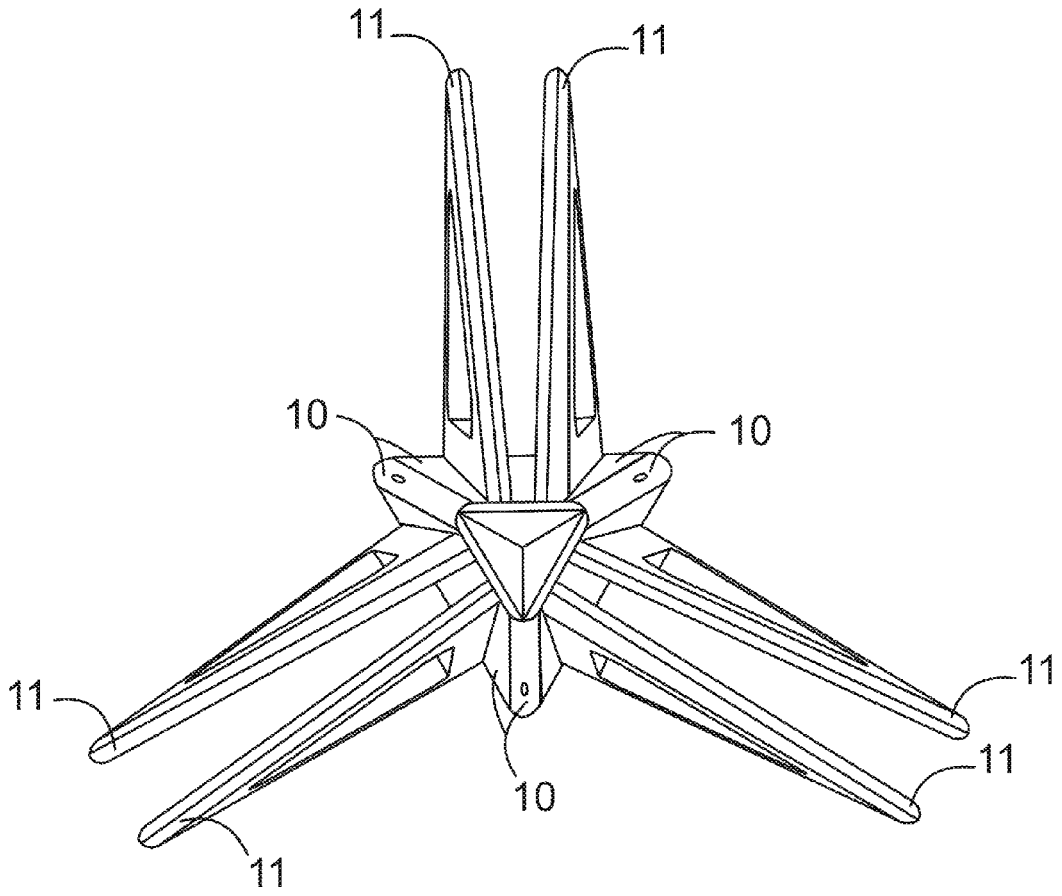
FIG. 11 shows another embodiment of the present invention without expandable blade.

In another embodiment of the present invention, there is no expandable blade between two fixed blades 11. Three sets of two fixed blades 11 increase the cutting ability of the arrowhead by itself as shown in FIG. 11. The fixed blades 11 are rigidly fixed to the main body 10.

Figure 12:
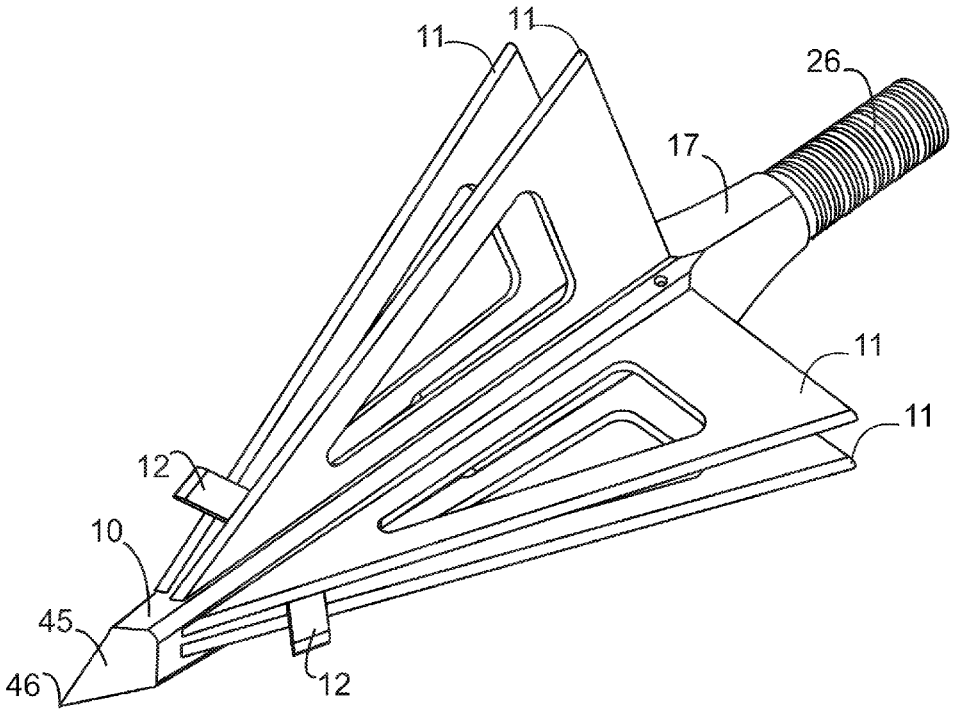
FIG. 12 shows another embodiment of the present invention with conical tip at its distal end.

In another embodiment of the present invention, the tip 45 of the main body 10 is conical shaped with sharp end 46 as shown in FIG. 12. The tip 45 of the main body 10 makes an important role for penetration purposes.

Figure 13:
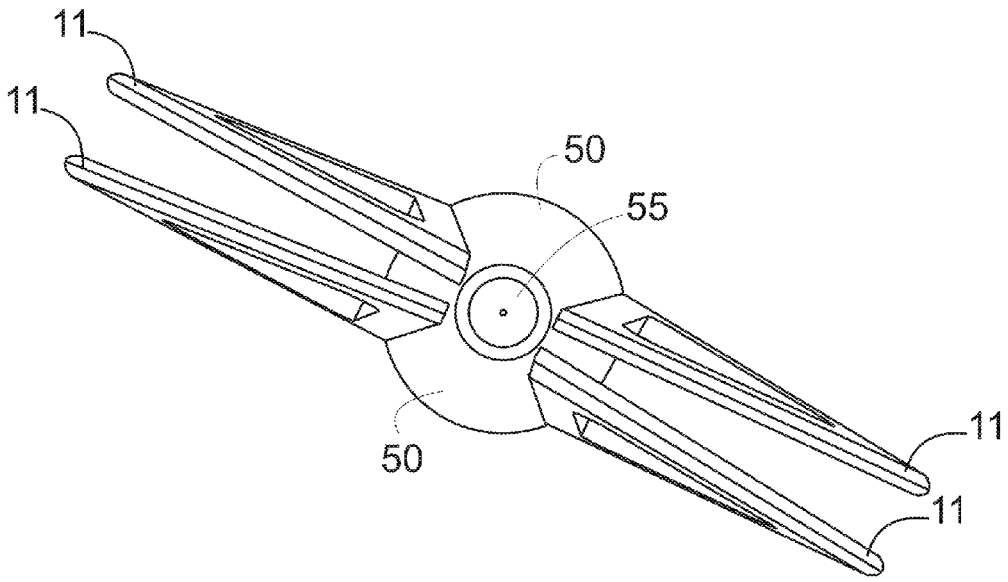
FIG. 13 shows another embodiment of the present invention with four fixed blade and optional expandable blade.

In another embodiment of the present invention as shown in FIG. 13, there are two sets of fixed blades 11 which are mounted in the conical body 50 with the sharp tip 55 at its distal end. The expandable blade (not shown) can be placed between two fixed blades for gradually expand while the fixed blades cut the animal's body and penetrate into the target.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A broadhead arrowhead comprising:

a. an elongated main body with substantially triangular cross section having a proximal and a distal end, said main body having three faces, each said face having three longitudinal grooves, each said groove sized to receive a blade, said main body having three pin-receiving apertures towards its distal end;

b. nine blades mounted on said grooves, wherein each said face having three blades, comprising of two side blades and one middle blade, wherein said side blades being fixed blades, and said middle blades being mechanically expandable blades;

c. said fixed blades being substantially triangular having a base which sits inside a groove, a blade web to cut, and a substantially perpendicular side to support the blade web, said base having a tip and an end, said end having an aperture; and d. each said expandable blade being slanted L-shaped having a longer length with a first-end and a shorter length with a second-end, said longer length of the L-shaped blade being placed inside said middle groove extending from the proximal to the distal end of the main body, and wherein the shorter length of the L-shaped blade extending outwardly close to the proximal end, said expandable blade having an aperture at its first-end, said L-shaped blade having sharp front edges to cut and penetrate;

e. means to attach said fixed and expandable blades to said main body; and f. means to attach said broadhead to an arrow, whereby each expandable blade opens when the shorter length of the L-shaped blade impacts a target, forcing it to pivot around the pin.

2. The broadhead of claims 1, wherein the spacing between the two fixed blades on each face being small enough to snug fit the expandable blade in between said fixed blades.

3. The broadhead of claims 1, wherein said means to attach said blades to the main body comprising of a pin inserted through said apertures on the blades and the main body, whereby the expandable blades pivot around said pins to an open position after impact.

4. The broadhead of claims 1, wherein said means to attach said broadhead to an arrow being a threaded male connector being attached to the proximal end of said main body.

5. The broadhead of claims 1, wherein said broadhead further having a substantially conical tip being attached to the distal end of said main body.

6. A twin-blade arrowhead comprising:

a. an elongated main body having a proximal and a distal end, six longitudinal grooves with three grooves on opposite sides of the main body, each said groove sized to receive a blade, said main body having two pin-receiving apertures towards its distal end;

b. a pair of three blades comprising of two side blades and one middle blade, wherein said side blades being fixed blades, and said middle blades being mechanically expandable blades;

c. said fixed blades being substantially triangular having a base which sits inside a groove, a blade web to cut, and a substantially perpendicular side to support the blade web, said base having a tip and an end, said end having an aperture;

d. each said expandable blade being slanted L-shaped having a longer length with a first-end and a shorter length with a second-end, said longer length of the L-shaped blade being placed inside said middle groove extending from the proximal to the distal end of the main body, and wherein the shorter length of the L-shaped blade extending outwardly close to the proximal end, said expandable blade having an aperture at its first-end, said L-shaped blade having sharp front edges to cut and penetrate;

e. means to attach said fixed and expandable blades to said main body; and f. means to attach said broadhead to an arrow, whereby each expandable blade opens when the shorter length of the L-shaped blade impacts a target, forcing it to pivot around the pin.

7. The twin-blade of claim 6, wherein the spacing between the two fixed blades on each face being small enough to snug fit the expandable blade in between said fixed blades.

8. The twin-blade of claim 6, wherein said means to attach said blades to the main body comprising of a pin inserted through said apertures on the blades and the main body, whereby the expandable blades pivot around said pins to an open position after impact.

9. The twin-blade of claim 6, wherein said means to attach said broadhead to an arrow being a threaded male connector being attached to the proximal end of said main body.

10. The twin-blade of claim 6, wherein said broadhead further having a substantially conical tip being attached to the distal end of said main body.

11. A multi-lever broadhead comprising:

a. an elongated main body with substantially triangular cross section having a proximal and a distal end, said main body having three faces, each said face having three longitudinal grooves, each said groove sized to receive a blade, said main body having three pin receiving apertures towards its distal end;

b. each said face having three blades, comprising of two side blades and one middle multi-lever blade, wherein said side blades being fixed blades, and said middle blades being mechanically expandable blades;

c. said fixed blades being substantially triangular having a base which sits inside a groove, a blade web to cut, and a substantially perpendicular side to support the blade web, said base having a tip and an end, said end having a first aperture to fix the blade on the main body, a second and a third aperture on its sides to receive the middle multi-lever blade;

d. each said multi-lever blade comprising of an expanding lever and a lifting lever, wherein said levers being pivotally attached to the sides of said fixed blades, whereby the lifting lever being engaged with the fix blades and pivots closer to the tip of the broadhead and having a clockwise rotation after impact with the target, and forcing the expanding lever to rotate counter-clockwise;

e. means to attach said fixed and expandable blades to said main body; and f. means to attach said broadhead to an arrow, whereby the clockwise rotation of said lifting lever results in a counterclockwise rotation of said expanding lever by pushing down one end of said expanding lever.

12. The multi-lever broadhead of claim 11, wherein said multi-lever blades having means to keep the expanding lever in a locked position after the full opening of said multi-lever-blade.

13. The multi-lever broadhead of claim 12, where said means to keep the longer lever-blades in a locked position being a cut groove on each face of the main body, said cut groove being placed in between the two fixed blade grooves and being shaped to receive one end of the longer lever-blade.

14. The multi-lever broadhead of claim 11, wherein the spacing between the two fixed blades on each face being small enough to snug fit the expandable blade in between said fixed blades.

15. The multi-lever broadhead of claim 11, wherein said means to attach said fixed blades to the main body comprising of a pin inserted through said apertures on the fixed blades and the main body.

16. The multi-lever broadhead of claim 11, wherein said means to attach said broadhead to an arrow being a threaded male connector being attached to the proximal end of said main body.

17. The multi-lever broadhead of claim 11, wherein said broadhead further having a substantially conical tip being attached to the distal end of said main body.

* * * * *